US006973913B2

(12) United States Patent
Knorpp et al.

(10) Patent No.: US 6,973,913 B2
(45) Date of Patent: Dec. 13, 2005

(54) FINAL CONTROL ELEMENT FOR CONTROLLING INTERNAL COMBUSTION ENGINES

(75) Inventors: Michael Knorpp, Weissach (DE); Michael Brozio, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/910,345

(22) Filed: Aug. 4, 2004

(65) Prior Publication Data

US 2005/0120997 A1 Jun. 9, 2005

(30) Foreign Application Priority Data

Aug. 7, 2003 (DE) ..... 103 36 265
Apr. 6, 2004 (DE) ..... 10 2004 016 912

(51) Int. Cl.[7] ..... F02D 9/10
(52) U.S. Cl. ..... 123/396; 123/399
(58) Field of Search ..... 123/336, 337, 123/361, 396, 399, 400, 403; 251/304, 305

(56) References Cited

U.S. PATENT DOCUMENTS 4,785,782 A * 11/1988 Tanaka et al. ..... 123/399
4,947,815 A * 8/1990 Peter ..... 123/399
5,060,613 A * 10/1991 Lieberoth-Leden et al. . 123/399
5,101,784 A * 4/1992 Tamaki ..... 123/337
5,333,584 A * 8/1994 Kamio et al. ..... 123/399
5,787,861 A * 8/1998 Suzuki et al. ..... 123/396
6,009,853 A * 1/2000 Fujikawa et al. ..... 123/396
6,067,958 A * 5/2000 Kamimura et al. ..... 123/399
6,320,285 B1 * 11/2001 Ito et al. ..... 310/36
6,418,908 B2 * 7/2002 Wayama et al. ..... 123/399
6,843,227 B2 * 1/2005 Han ..... 123/396
2004/0060541 A1 * 4/2004 Soshino et al. ..... 123/399

* cited by examiner

*Primary Examiner*—Willis R. Wolfe, Jr.
(74) *Attorney, Agent, or Firm*—Ronald E. Greigg

(57) ABSTRACT

A final control element movable between a minimal and a maximal position for controlling an internal combustion engine is acted upon by a first spring element acting in the closing direction and a second spring element acting in the opening direction, the latter having a first end and a second end. The first end of the second spring element is supported in stationary fashion in a housing. The second spring element transmits its intrinsic tension in the tangential and radial directions either to a bearing point on the final control element or to a second bearing point of the housing and is adjustable in its angular position by means of an adjustable stop.

17 Claims, 5 Drawing Sheets

FINAL CONTROL ELEMENT FOR CONTROLLING INTERNAL COMBUSTION ENGINES

BACKGROUND OF THE INVENTION

1. Field of the Invention

In the automotive field, final control elements for controlling internal combustion engines are used that keep a control element between a minimal and a maximal position. A typical embodiment uses two spring elements, of which one works in the opening direction and one in the closing direction, and of which, one spring element at a time is not operative in a partial range. The spring acting in the closing direction is typically embodied as a helical or spiral spring, while the spring acting in the opening direction is embodied as a helical spring and as a leaf spring.

2. Description of the Prior Art

Final control elements for controlling internal combustion engines that have a currentless position between a minimal and a maximal position are known for instance from German Patent Disclosures DE 36 31 283 and DE 39 08 596. The final control elements known from these references each include two spring elements, one of which acts in the opening direction and one in the closing direction.

From German Patent Disclosure DE 38 32 400 A1, an apparatus with a control motor for engagement with a transmission element is known. In this reference, an apparatus includes a control motor for engagement with a transmission element. The transmission element is operative between a human control element and a control device that determines the power of a driving machine. The human control element is connected to a rotary member, and the control device is connected to a second rotary member mechanism. A tension spring is also provided, which acts on the one hand on the first rotary element and on the other on the second rotary element, in such a way that the rotary elements seek to execute a rotary motion relative to one another, until a stop of one rotary element meets a stop of the other rotary element. A third rotary element is disclosed, with which the control motor is operatively connected and by which the second rotary element is rotatable. Between the first and third rotary elements there is a coupling, which is inoperative in a certain position of these rotary elements relative to one another. The third rotary element can be restored to a restoring element by means of at least one reverse rotation spring assembly acting directly or indirectly on the third rotary element. The reverse rotation spring assembly can either be operative in only one direction of rotation or, depending on the position of the third rotary element, in either one or the other direction of rotation. The reverse rotation spring assembly comprises at least one reverse rotation spring with two spring ends, of which the first spring end housing is fixedly supported, and the second spring end can act on the third rotary element in a reverse rotation direction via an attachment on the third rotary element.

OBJECT AND SUMMARY OF THE INVENTION

By means of the provisions proposed according to the present invention, an easily installed restoring element for final control elements for controlling internal combustion engines is furnished which can be used for instance in a throttle device in the intake tract of an internal combustion engine or inside an exhaust gas recirculation valve in the exhaust tract of an internal combustion engine. The provisions proposed according to the invention are distinguished in that the restoring element of the final control element is embodied as an easily installed spring element which is retained in its position merely by housing stops under its own intrinsic initial tension. This makes for installation that is both economical and simple. The spring element proposed according to the invention, which can be embodied as a leaf spring, not only transmits torque but also brings a radially outward-acting force to bear. By means of this radial force, it is possible for the restoring element, upon installation, to slide on its own into its fastening variant and to maintain this position even during operation. The movable end of the restoring element is pressed either into a driver or into a bearing point, depending on the spring range, by this outward-acting radial force. Inside the bearing point, which may be embodied in a housing of a throttle device, the end received there of the restoring element has play. Because the bearing point has play, greater tolerances are acceptable for the individual parts; moreover, the design of the bearing point as a bearing point with play makes for easier installation.

The unambiguous, defined contact of the restoring element is first achieved by the action of the spring forces. Compared to the version known from DE 38 32 400 A1, in the version proposed here, one additional receptacle and one fastening element on one end of the final control element can be dispensed with.

Because of the simple installation, which is represented for instance by the bearing point, designed with play, inside a housing of a throttle device, a minimization of the number of components is attained compared to the version known from the prior art as defined by DE 38 32 400 A1. Advantageously, the restoring element is embodied as a C-shaped leaf spring which is prestressed by means of housing stops. The primary shape of the restoring element that can be embodied in a C shape advantageously covers an angular range between 180° and 360°. The term "primary shape" of the restoring element that can be embodied in the shape of a C is understood to mean the shape of the leaf spring without its spring ends that are bent at an angle, or in other words it essentially means the curved region of the leaf spring extending between the spring elements that are bent at an angle.

In a further variant of the embodiment proposed according to the invention, which cooperates with a throttle valve that meets a stop and additionally with an external, lower mechanical stop, the currentless position of the emergency air position can be made adjustable to compensate for tolerances in the angular position. To achieve this compensation of tolerances, an adjusting screw may be provided at the appropriate bearing point of the leaf spring in the emergency air position and acts on the movable arm of the leaf spring. Depending on the depth to which the adjusting screw, which may for instance be in the form of a grub screw, is screwed in, the angular position of the movable arm of the leaf spring is varied. Varying the angular position of the movable arm of the leaf spring can take into account the fact that if there is a fixed connection between a toothed segment and the corresponding throttle valve shaft, it is not possible to compensate for tolerances by way of their fixed connection with one another, but the angular position of the leaf spring can be made adjustable.

BRIEF DESCRIPTION OF THE DRAWINGS

The invention will be better understood and further objects and advantages thereof will become more apparent from the ensuing detailed description of preferred embodiments, taken in conjunction with the drawings, in which.

DESCRIPTION OF THE PREFERRED EMBODIMENTS

Figure 1:
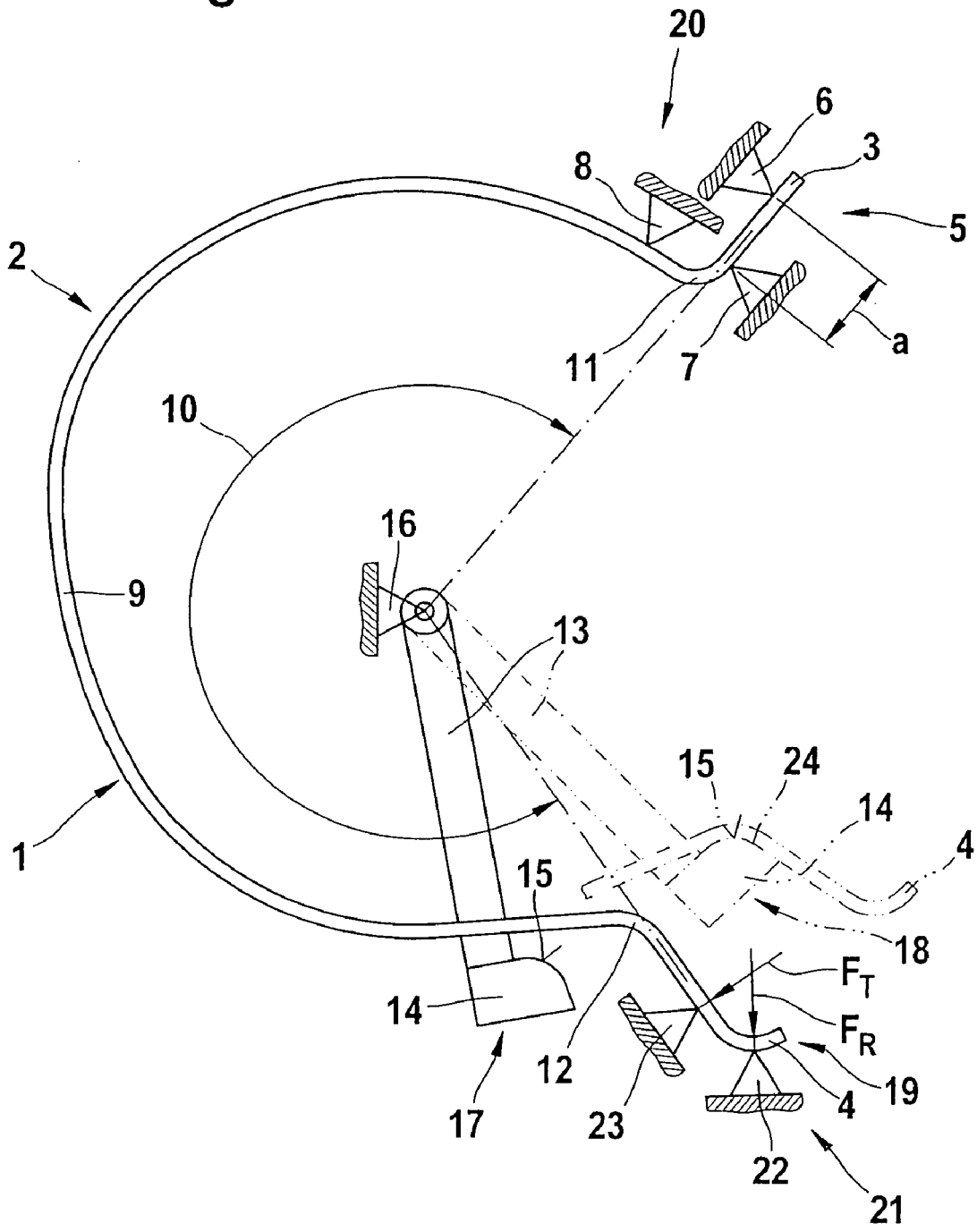
FIG. 1 shows the restoring element proposed according to the invention in a first variant fastening.

FIG. 1 shows spring element 1, which is essentially C-shaped by design, having a first end 3 and a second end 4. The first end 3 of the spring element 1 is received, at a first bearing point 5, in a housing not shown in FIG. 1. The first bearing point 5 includes a first support 6 and a second support 7. The supports 6 and 7 are received at a spacing a offset from one another relative to the first end 3 of the spring element 1. Moreover, the first bearing point 5 for the first end 3 of the spring element 1 has a third support 8, which is offset by an angle of approximately 90° from the first support 6 of the first bearing point 5. The supports 6, 7, 8 of the first bearing point 5 of the spring element 1, in the illustration in FIG. 1, stand for stop faces on which the first end of the spring element 1 rests in a housing and is received there with play.

The spring element 1, preferably embodied as a leaf spring, has a curvature 9. The curvature 9 is embodied such that a primary shape 10 is created with which the curved region of the spring element 1 extends over an angle of between 180° and 360°.

The spring element 1 embodied as a leaf spring has a first bend 11, which amounts to approximately 90° and may also be embodied at other angles, where the first spring end 3 changes over to the C shape 2 of the spring element 1. The spring element 1 furthermore has a second bend 12, which is embodied in the region of the second end 4 of the spring element 1. The second bend 12 may be embodied in an angular range of between 30° and 90°, preferably 45° or 60°. In the illustration in FIG. 1, the spring element 1 is shown with its second, movable end 4, because of its intrinsic tension acting in the tangential and radial directions, against a second bearing point 21 of a housing not shown in FIG. 1. The second bearing point 21 of the spring element 1 has a first support 22 and a second support 23. The forces $F_T$ (tangential force) and $F_R$ (radial force) that are transmitted because of the intrinsic tension of the spring element 1 are transmitted to the first support 22 and the second support 23, respectively, of a housing.

The spring element 1 is associated with a final control element 13, shown only schematically in FIG. 1, in accordance with a first fastening variant 20. The final control element 13 is movable about a bearing point 16 and can be moved to arbitrary intermediate positions between a resting position 17 and a deflected position 18 shown in dashed lines in FIG. 1. The final control element 13 has a head region 14, on which a contact face 15 is embodied. The contact face 15 of the final control element 13 is embodied in accordance with the curvature of the second bend 12 in the region of the second, movable end 4 of the spring element 1 and upon contact with it forms a bearing point 24 for the spring element 1 that is embodied with a C shape 2.

In the resting position 17 of the final control element 13, the spring element 1, because of its intrinsic tension, is moved into the first bearing point 5 and the second bearing point 21 of a housing not shown in FIG. 1 and rests on the supports 6, 7 and 8 of the first bearing point 5 and on the supports 22, 23 of the second bearing point 21 in the housing. As long as the final control element 13 does not enter into engagement with the spring element 1, preferably embodied as a leaf spring, the second, movable end 4 of the spring element 1 remains in its position shown in FIG. 1. If the final control element 13 is moved by a drive mechanism into its deflected position 18, the head region 14 of the final control element 13, with its contact face 15, moves toward the second bend 12 in the region of the second, movable end 4 of the spring element 1 and contacts this bend and deflects the second, movable end 4 of the spring element 1 into the position shown in dashed lines in FIG. 1. In this state of the second, movable end 4 of the spring element 1, the intrinsic tension of the spring element 1 is transmitted to the final control element 13 in both the tangential and the radial directions, as represented by the arrows $F_T$, $F_R$ in FIG. 1, in the deflected position 18 of the final control element 13.

As long as the variant embodiment, shown in FIG. 1, of the spring element 1 preferably embodied as a leaf spring is not contacted by the final control element 13, the spring element 1 remains in its position inside the housing by its intrinsic initial tension. To facilitate the installation of the spring element 1 designed according to the invention in a housing, the first bearing point 5 is embodied with play, so that simple insertion of the first end 3 of the spring can be done into the contact faces of the housing that are represented by the supports 6, 7 and 8.

Figure 2:
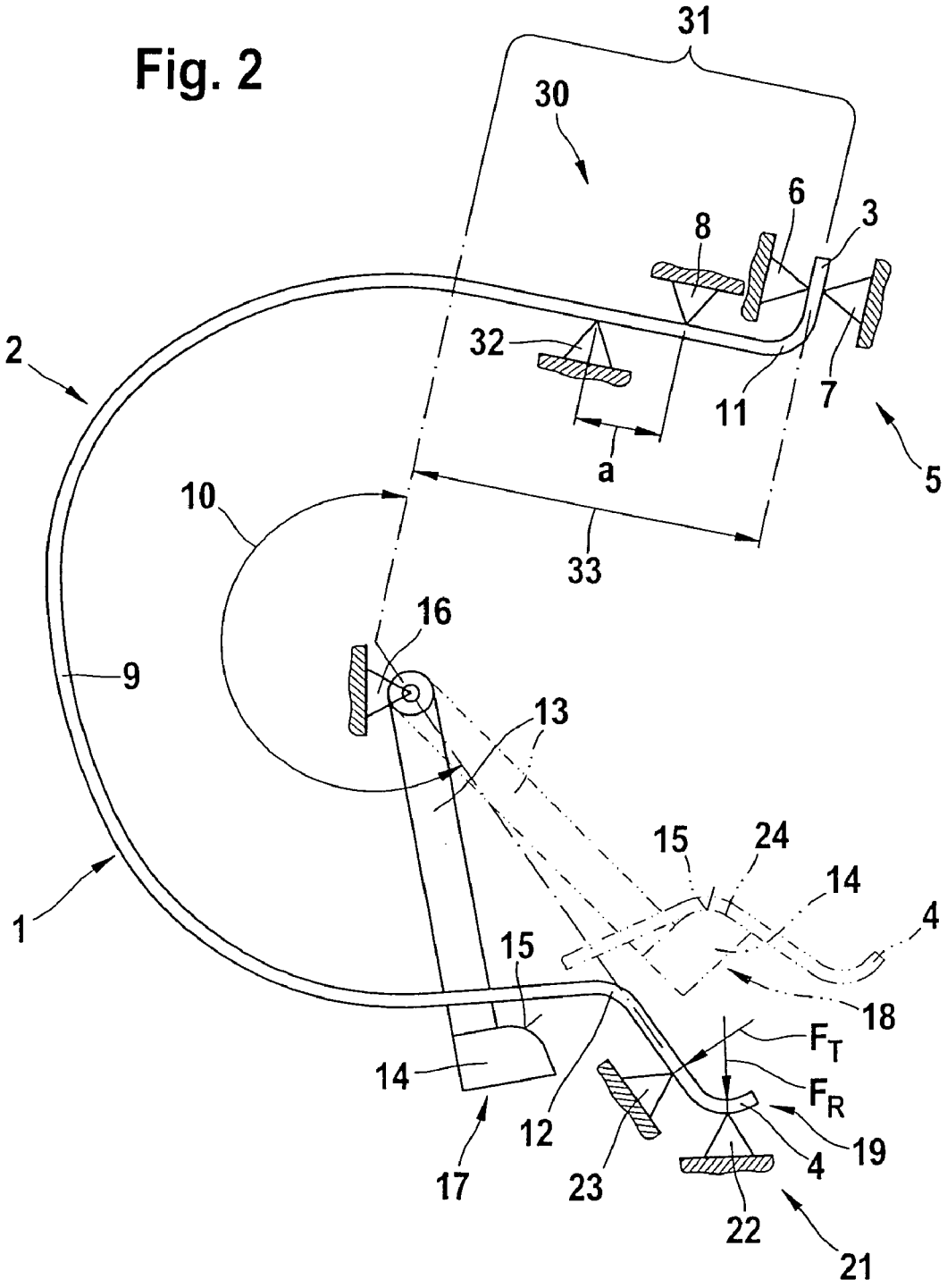
FIG. 2 shows the restoring element proposed according to the invention, embodied as a C-shaped leaf spring, in a second variant fastening.

From the illustration in FIG. 2, a further fastening variant can be seen of the spring element proposed according to the invention and acting on a final control element. In this embodiment, spring element 1 which acts on the schematically shown final control element 13 includes a straight portion 31 that changes over to the primary shape 10. The straight portion 31 of the spring element 1, which in this variant embodiment is again preferably embodied as a leaf spring, is located between the curved region 9 of the spring element 1 and the first bend 11 of the spring element 1. The first bend 11 in the region of the first end 3 of the spring is embodied as a 90° bend. Bending angles within a range of 90°±60° are possible. In the second fastening variant 30, shown in FIG. 2, of the spring element 1, the first bearing point 5 is embodied such that the first support 6 and the second support 7 are located opposite one another. From a production standpoint, this kind of support can be represented by a slot in a housing, into which the first end 3 of the spring element 1 is inserted. Furthermore, the first bearing point 5 for the first end 3 of the spring element 1 has the third support 8, which is rotated 90° relative to the first support 6 of the first bearing point 5. Opposite the third support 8, there is a further support 32 at a spacing a. The straight portion 31 is embodied with a length 33. In this variant embodiment of the first bearing point 5 for the first spring end 3, the fastening position of the first spring end 3 of the spring element 1 is predetermined by the design of the first bearing point 5 in the housing. The primary shape 10 is located, analogously to a variant embodiment of the spring element 1 shown in FIG. 1, in an angular range between 180° and 360°. It can be seen from the second fastening variant 30 shown in FIG. 2 that in the resting position 19 of the spring element 1, this spring element is pressed by its intrinsic tension in the radial and tangential directions against the supports 22 and 23 of the second bearing point 21 in a housing not shown in FIG. 2. As soon as the final control element 13 is moved from its resting position 19 into its deflected position 18 or into an intermediate position, the second, movable spring end 4 is deflected into its position shown in dashed lines in FIG. 2. The contact face 15, embodied in curved form, on the final control element 13 forms the bearing point 24, at which the forces $F_R$ and $F_T$ acting in the radial and tangential directions because of the intrinsic tension of the spring element 1 are transmitted. In the deflected position 18, shown in dashed lines in FIG. 2, of the final control element 13 and of the second, movable spring end 4, the second, movable spring end 4 of the spring element 1 is raised from the second bearing point 21, or in other words from the supports 22 and 23.

Figure 3:
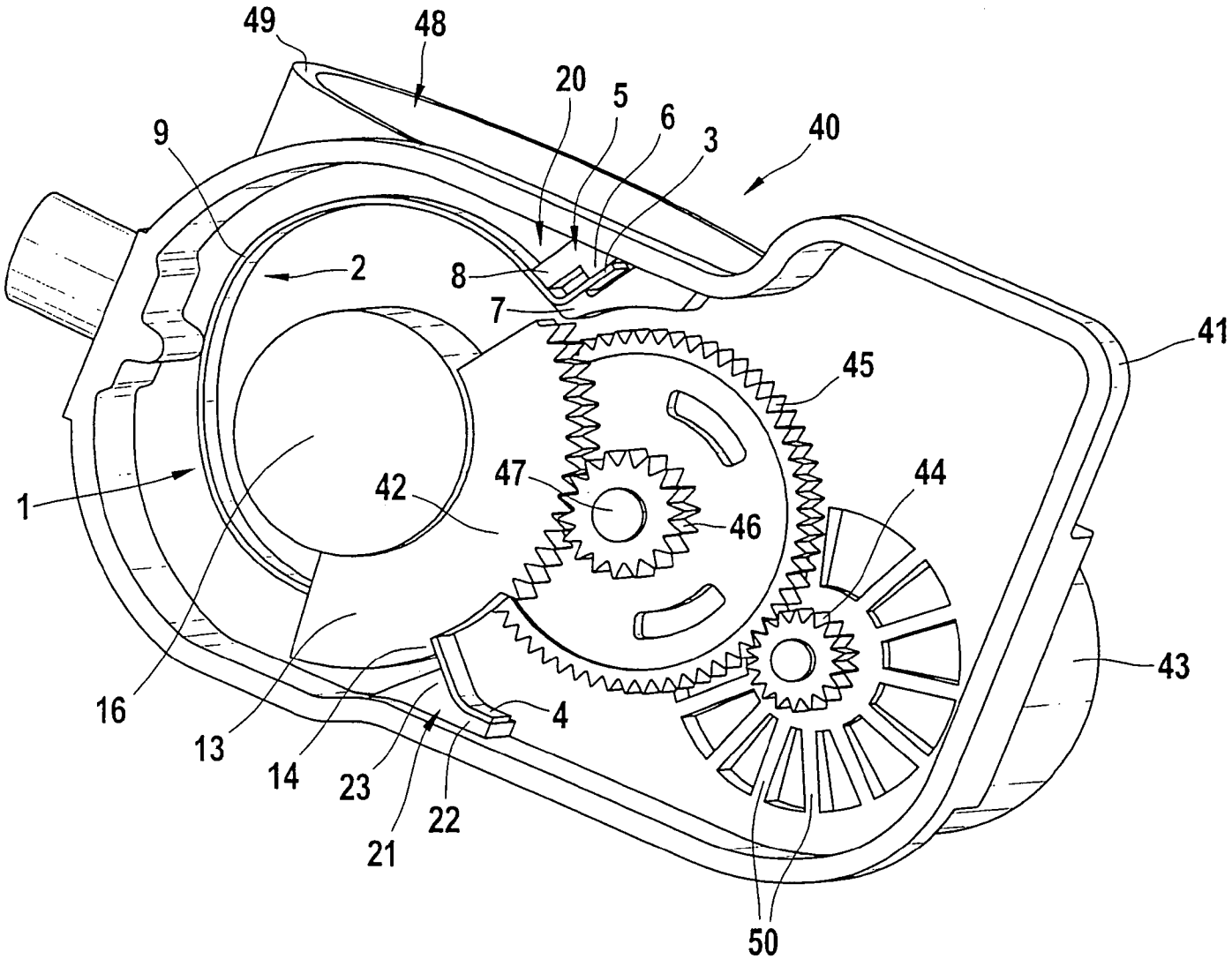
FIG. 3 shows the drive side of a throttle device, which is received in the intake tract of an internal combustion engine, with a restoring element proposed according to the invention and associated with the inside of the final control element.

FIG. 3 shows the use of the spring element, proposed according to the invention and acting on the final control element, in a throttle device 40 whose housing side toward the drive mechanism is shown. On the drive side of a housing 41, there is a pinionlike drive wheel 44, which is driven via a drive mechanism 43. The drive wheel 44 meshes with a first transmission element 45, which is received on a shaft 47 on which shaft a second, likewise pinionlike transmission element 46 is received in a manner fixed against relative rotation. The second transmission element 46 of the common shaft 47 meshes with a toothed segment 42 which is embodied on the final control element 13. The leaf spring-like spring element 1 embodied with the C shape 2 is located behind the final control element 13. The first end 3 of the spring element 1 is received in the slotlike first bearing point 5 in the housing 41 of the throttle device 40, while the second, movable end 4 of the spring element 1 is received in the second bearing point 21 of the housing 41. In the view in FIG. 3, the spring element 1 is fastened into the housing 41 of the throttle device 40 in the first fastening variant 20, which is described in further detail in conjunction with FIG. 1. It can be seen from FIG. 3 that the spring element 1, embodied as a leaf spring, has the curvature 9 which extends over an angular range of between 180° and 360°. The second, movable end 4 of the spring element 1, as shown in FIG. 3, rests on the first support 22 and the second support 23 of the second bearing point 21 of the housing 41. In the region of the second bend 12, which is embodied at an angle of between 30° and 90° but preferably 45° or 60°, the final control element 13 rests, with its contact face 15 embodied on its head region 14, on the spring element 1 that is preferably embodied as a leaf spring. In the position shown in FIG. 3, the final control element 13 is still barely not touching the second, movable end 4 of the leaflike spring element 1. As a result, the second, movable end 4, because of its intrinsic tension acting in the tangential and radial directions, rests on the supports 22, 23 of the second bearing point 21 of the housing 41. The final control element 13 is rotatable about the final control element bearing 16. Extending concentrically to the bearing 16 of the final control element 13 that has the toothed segment 42 is a throttle valve shaft, which is not shown in FIG. 3 because it is concealed and on which a throttle valve is received. The gas stream passing through a gas flow opening 48 in the throttle device 40 is controlled by the throttle valve. The wall which penetrates the gas flow opening 48 of the housing 41, preferably embodied as an injection-molded component, of the throttle device 40 is identified by reference numeral 49. The region of the housing 41 where the drive shaft of the drive mechanism 43 penetrates the housing 41 is provided with a reinforcing ribbing 50. The supports 22 and 23, shown schematically in FIG. 1, of the second bearing point 21 for spring element 1 in the housing 41 are embodied, in the view of FIG. 3, as contact faces, on which the second, movable end of the spring element 1, preferably embodied in leaflike form, rests. Because of its intrinsic tension, the spring element 1, as long as it is not deflected by the final control element 13 that can be pivoted about the bearing point 16, remains in its fastening variant inside the housing 41, or in other words is pressed against the contact faces of the first bearing point 5 and the second bearing point 21 inside the housing 41 of the throttle device 40. As soon as the second, movable end 4 of the spring element 1 is deflected by a rotary motion of the final control element 13 about its axis 16, the intrinsic tension of the leaflike spring element 1, which acts in both the tangential and the radial directions, is transmitted to the deflected final control element 13.

If the first bearing point 5, in which the supports 6, 7, 8, which are preferably embodied as contact faces for the first end 3 of the spring element 1, is manufactured in slot form, then advantageously simply placing the leaflike spring element 1 in the housing 41 suffices. After the leaflike spring element 1 has been placed and fastened in the housing 41 of the throttle device 40, its ends 3 and 4 are thrust into the first bearing point 5 and the second bearing point 21, respectively, so that the spring element 1 is prestressed in the respective bearing points 5 and 21.

Figure 4:
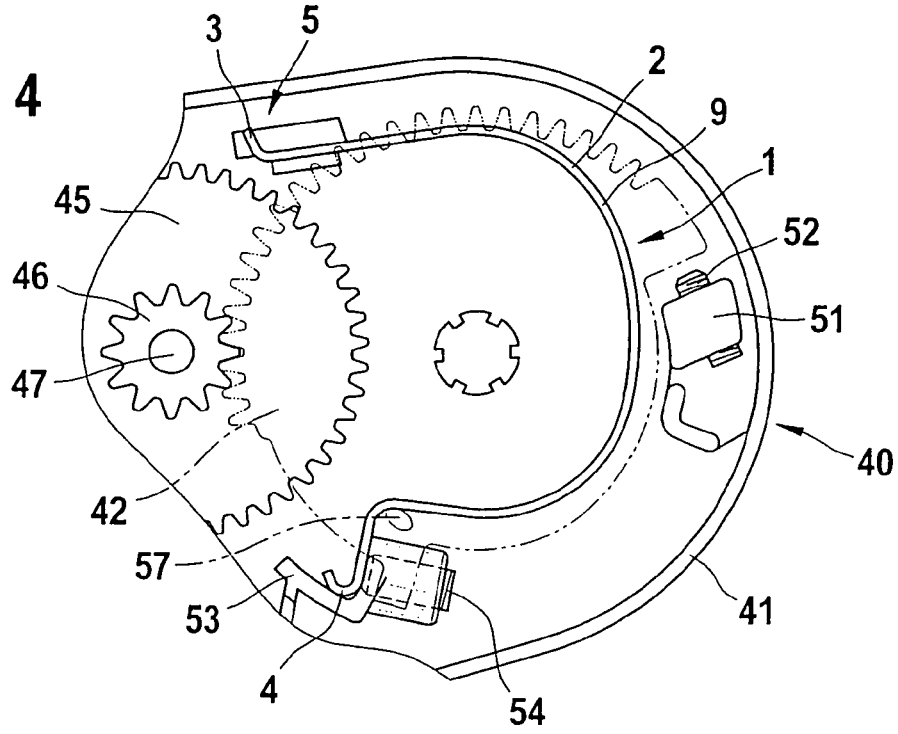
FIG. 4 shows a leaf spring, let into the housing on the drive side of a throttle device, whose movable arm can be prestressed via a stop that is provided with an adjusting screw.

In a further variant embodiment of the version proposed according to the invention, the housing 41 of the throttle device 40 includes an external, lower mechanical stop 51 (FIG. 4) as well as a further, adjustably embodied stop, which serves to adjust the emergency air position. The spring element 1 embodied like a leaf spring in the curvature 9, is fixedly fastened by its first end 3 at the first bearing point 5 of the housing 41. The second, movably embodied end 4 of the leaf-spring-like spring element 1 is located opposite a guide rib 53, which is embodied in the housing 41 of plastic. The second end 4 of the spring element 1 embodied like a leaf spring is located facing a second adjusting screw 54 for adjusting the emergency air position. Via the second adjusting screw 54, the prestressing of the movable arm of the spring element 1 can be varied. From FIG. 4, it can furthermore be seen that above the leaflike spring element 1 embodied in the curvature 9 there is a toothed segment 42. The toothed segment 42, with its toothing, meshes with the second transmission element 46, which is received on the common fixed shaft 47 on which the first transmission element 45 is also located. The drive mechanism associated with the common fixed shaft 47 is not shown in FIG. 4 (but see FIG. 3), for the sake of greater clarity.

Reference numeral 57 designates a driver which is embodied on the toothed segment 42 and cooperates with the spring element 1 in the form of a leaf spring.

The degree of rotation of the toothed segment 42 may be varied via an adjusting screw 52 disposed in the external, lower mechanical stop 51, while the angular position of the movable arm of the spring element 1 embodied like a leaf spring, is possible via a rotation of the adjusting screw 54. In this variant embodiment, it is accordingly possible, for compensating for tolerances, to adjust the angular position of the spring element 1, embodied like a leaf spring, cooperating with the toothed segment 42 by way of an actuation of the second adjusting screw 54 with respect to its emergency air position. The toothed segment 42 includes a cam, which is located opposite an adjusting screw that is received in the external, lower mechanical stop 51. The stop position of the cam and thus the course of rotation of the toothed segment 42 are limited by means of a rotation of the adjusting screw 52 in the external, lower mechanical stop 51.

Figure 5:
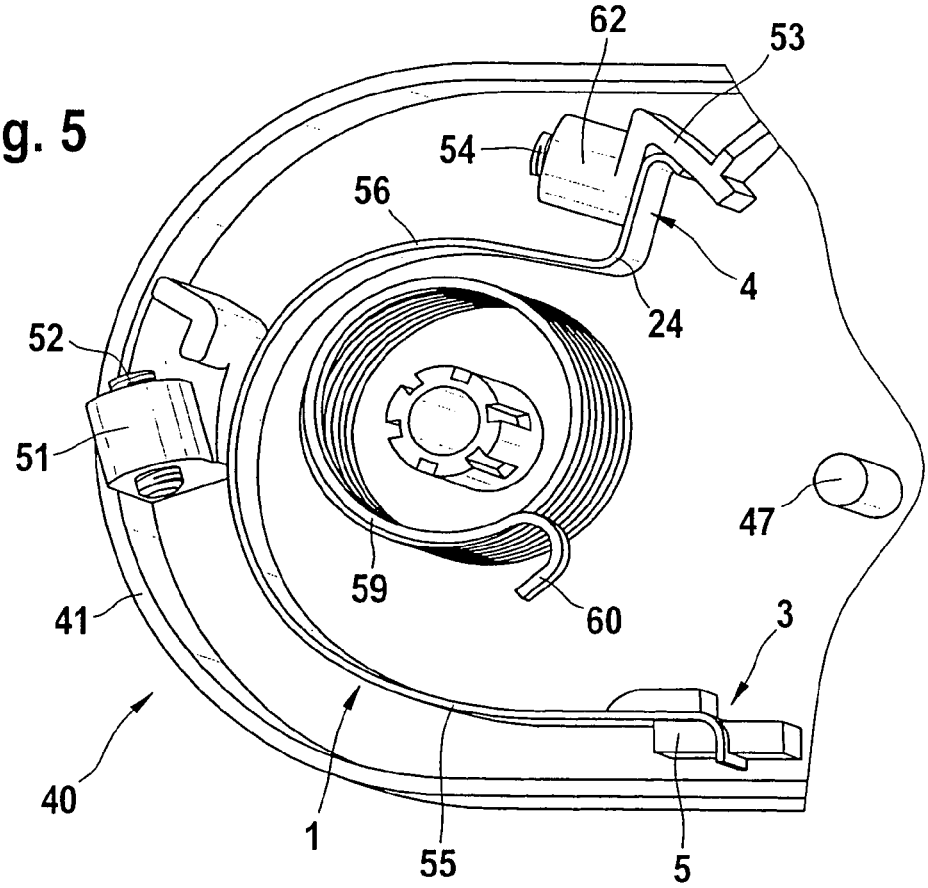
FIG. 5 shows the leaf spring, whose fixed arm is fastened in place and whose movable arm can be acted upon by a stop with an adjusting screw.

In the view shown in FIG. 5, the toothed segment 42 (not shown) is prestressed via a helical/torsion spring 59 whose end is embodied as a hook 60. By means of the hook 60, which is suspended from the toothed segment 42, the spring force is transmitted to the toothed segment 42 in order to effect its restoration. It can be seen from the view in FIG. 5 that a fixed arm 55 of the leaflike spring element 1 is fastened firmly in place on the first end 3 in the first bearing point 5. A movable arm 56 of the leaflike spring element 1, on which the bearing point 24 for the drivers of the toothed segment 42 is embodied, comes to an end at the second end 4. The second end 4 of the movable arm 56 has the guide rib 53 fitting over it in the housing 41. The adjusting screw 54 for determining the emergency air position is let into the stop base 62. Rotating the adjusting screw 54 can move the second end 4, embodied in the form of a right-angle bend, of the leaflike spring element 1. As also seen from FIG. 5, the external, lower mechanical stop 51 is located in the housing 41. It receives the adjusting screw 52 for determining the maximum rotated position of the toothed segment 42, not shown in FIG. 5 and acted upon by the helical/torsion spring 59. Reference numeral 47 indicates the common shaft, likewise injection-molded into the housing 41, on which shaft both the first transmission element 45 and the second transmission element 46, which meshes with the toothed segment 42, are received.

Figure 6:
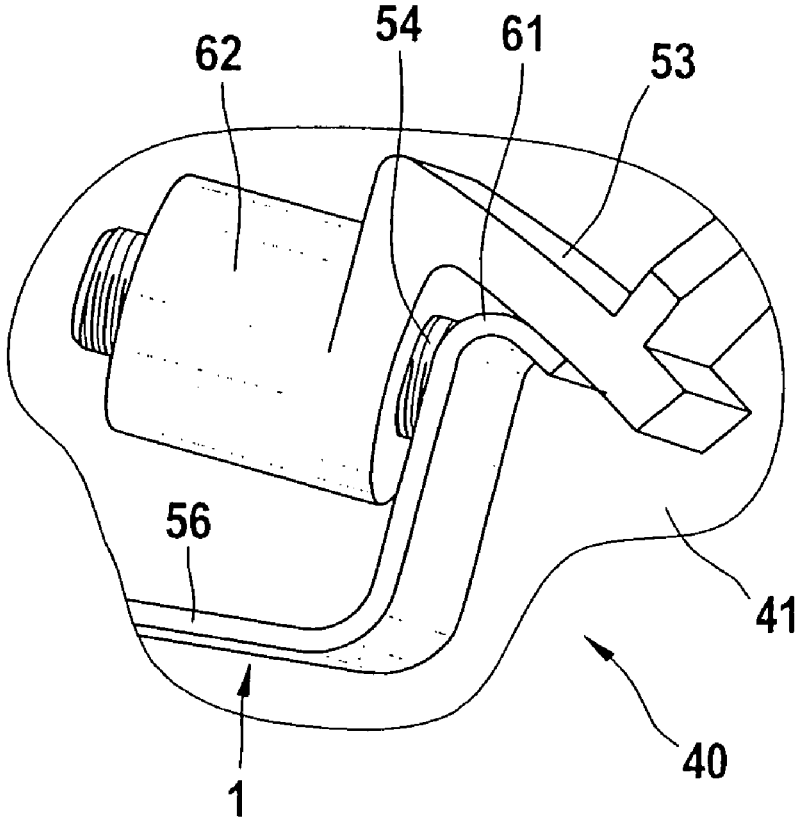
FIG. 6 shows the stop, acting on the movable arm of the leaf spring, with the adjusting screw.

In FIG. 6, the stop base 62, which supports the adjusting screw 54 for determining the emergency air position, can be seen on a larger scale. Once again, it is injection-molded into the housing 41, the latter preferably embodied as an injection-molded plastic component. The right-angle bend 61 of the free end 4 of the movable arm 56 is located below the grip 53.

The spring element 1 embodied as a leaf spring, in the prestressed installation position, is braced firmly on the housing 41 by its fixed arm 55 on the first bearing point 5. The movable arm 56 is movable, with its end embodied with a right-angle bend 61, along the guide rib 53 and rests tangentially on the adjusting screw 54 for determining the emergency air position. The driver, embodied on the toothed segment 42 and meshing with the bearing point 24 of the movable arm 56, travels over a shorter radius, compared to the bent part of the movable arm 56 of the spring element 1 in the form of a leaf spring. It is assured as a result that the driver 57, coming from the direction of maximal opening, lifts the movable arm 56 inward radially away from the guide rib 53. In the further motion out of the emergency air position in the direction of a minimal opening of the throttle valve, the movable arm 56 accordingly does not rub along the guide rib 53. The guide rib 53 is embodied as an arc that is concentric with the throttle valve shaft. Because of this, the movable arm 56 of the spring element 1 may have an adjusting range of ±1.5 mm, in every position of the adjusting screw 54 for determining the emergency air position. Moreover, this always assures the same radial spacing from the center of rotation. As a result, the radial spacings of the driver 57 of the toothed segment 42, which rests on the movable arm 56, relative to the movable arm 56 within the adjustment range are always the same.

The foregoing relates to preferred exemplary embodiments of the invention, it being understood that other variants and embodiments thereof are possible within the spirit and scope of the invention, the latter being defined by the appended claims.

We claim:

1. In a final control element for controlling an internal combustion engine, which is movable between a minimal and a maximal position and is acted upon by a first spring element acting in the closing direction and a second spring element (1) acting in the opening direction, which second spring element has a first end (3) and a second end (4), the first end (3) of the second spring element being received in a housing (41), the improvement wherein the second spring element (1) transmits its intrinsic tension in radial and tangential directions either to a bearing point (24) embodied on the final control element (13) or to a second bearing point (21) of the housing (41).

2. The final control element in accordance with claim 1, wherein the second spring element (1) rests with its ends (3, 4) in bearing points (5, 21) of the housing (41), as long as the final control element (13) is not in engagement with the spring element (1).

3. The final control element in accordance with claim 1, wherein the second spring element (1), when it is in engagement with the final control element (13), rests in the region of the second, movable end (4) with a contact face (12) on a contact face (15) of the final control element (13).

4. The final control element in accordance with claim 1, wherein the bearing point (24) for the deflected final control element (13) is embodied as a bend (12) on the second spring element (1), which bend is engaged by a stop side (15) of a head (14) of the final control element (13).

5. The final control element in accordance with claim 1, wherein the final control element (13) acts upon a throttle valve of a throttle device (40) in the intake tract of an internal combustion engine.

6. The final control element in accordance with claim 1, wherein the first bearing point (5) of the second spring element (1) has at least two supports (6, 7) in the housing (41) and has play.

7. The final control element in accordance with claim 6, wherein the first bearing point (5) is embodied in slotlike form in the housing (41).

8. The final control element in accordance with claim 1, wherein the second spring element (1) is embodied as a C-shaped leaf spring, whose primary shape (10) is between 180° and 360°.

9. The final control element in accordance with claim 8, wherein the primary shape (10) of the second spring element (1) covers a 270° angular range.

10. The final control element in accordance with claim 8, wherein the second spring element (1), besides the primary shape (10), has an extended portion (31), which adjoins a first bend (11) in the region of the first end (3) of the spring.

11. The final control element in accordance with claim 1, wherein the final control element is embodied as a toothed segment (42) which cooperates with a stop (51) structurally connected to the housing.

12. The final control element in accordance with claim 11, wherein the stop (51) is embodied with an adjusting screw (52) for defining the course of rotation of the toothed segment (42).

13. The final control element in accordance with claim 11, wherein the toothed segment (42) has a driver (57) cooperating with a bearing point (24) on the spring element (1).

14. The final control element in accordance with claim 1, wherein the second bearing point (21) of the second spring element (1) in the housing (41) includes a first support (22) for absorbing radial forces and a further support (23) for absorbing tangential forces.

15. The final control element in accordance with claim 14, wherein the further support (23) of the second bearing point (21) is embodied adjustably for absorbing tangential forces.

16. The final control element in accordance with claim 15, further comprising an adjusting element (54) embodied in the further support (23) of the second bearing point (21).

17. The final control element in accordance with claim 16, wherein the adjusting element (54) is embodied as an adjusting screw.

* * * * *